US006727440B1

(12) United States Patent
Wen et al.

(10) Patent No.: US 6,727,440 B1
(45) Date of Patent: Apr. 27, 2004

(54) ELECTROMECHANICAL PROGRAM TIMER WITH DELAY SECTIONS

(75) Inventors: We-Chieh Wen, Hsinchu (TW); Shih-Chi Chan, Hsinchu (TW)

(73) Assignee: Norm Pacific Automation Corp., Hsinchu (TW)

( * ) Notice: Subject to any disclaimer, the term of this patent is extended or adjusted under 35 U.S.C. 154(b) by 0 days.

(21) Appl. No.: 10/633,649

(22) Filed: Aug. 5, 2003

(30) Foreign Application Priority Data

May 30, 2003 (TW) ..... 92209989 U

(51) Int. Cl.[7] ..... H01H 43/10; H01H 7/08
(52) U.S. Cl. ..... 200/38 R; 200/38 B; 200/33 B
(58) Field of Search ..... 200/38 B, 39 B, 200/33 R

(56) References Cited

U.S. PATENT DOCUMENTS 4,500,212 A * 2/1985 Wojtanek ..... 368/108
4,649,239 A 3/1987 Duve
4,980,523 A * 12/1990 Aigner et al. ..... 200/38 R
5,831,230 A * 11/1998 Cole ..... 200/38 R
5,889,243 A * 3/1999 Edwards et al. ..... 200/35 R

* cited by examiner

*Primary Examiner*—Karl D. Easthom
*Assistant Examiner*—K. Lee
(74) *Attorney, Agent, or Firm*—Rabin & Berdo, P.C.

(57) ABSTRACT

An electromechanical program timer provides at least a section with a slower timing speed besides a major timing speed. The timer includes a driving motor rotationally drives a driving shaft. A driving gear and an eccentric shaft are formed on the driving shaft for driving a cam disk through a main driven gear and via a pushing pawl to a driven ratchet respectively. The main driven gear includes at least a missing gear portion where the driving gear is free from driving the main driven gear, and the pushing pawl and the driven ratchet take place. The driving shaft engages and rotates the cam disk through the main driven gear in a major timing speed. While at the missing gear portion, the eccentric shaft oscillates the pushing pawl and drives the cam disk through the driven ratchet step by step in a reduced timing speed.

9 Claims, 8 Drawing Sheets

ELECTROMECHANICAL PROGRAM TIMER WITH DELAY SECTIONS

BACKGROUND OF THE INVENTION

1. Field of the Invention

The invention generally relates to an electromechanical program timer, and in particular relates to a program timer having at least a section with reduced timing speed different from a major timing speed.

2. Related Art

There have been so many home appliances, such as air conditioners, televisions, dishwashers and clothes washing machines, which help people comfortable and easy in their daily lives. No wonder how hard it would be for us if all these appliances were gone.

Many home appliances have timer functions that control the appliances on/off or other functions according to user's or the appliance default settings. In a washer, for example, a dial knob is provided for user to choose programs of automatic washing and drying. The dial usually is an electromechanical program timer having a cam drum or a cam disk driven by a gear reduction motor for activating several electrical contact portions (blade switches) in predetermined timing defined by tracks on the cam unit. Correspondent actuators, such as water inlet solenoid, heater, spinning motor and draining motor, that connected to the contact switches are then controlled on and off by each track of the cam unit. There is a kind of driving mechanism of the cam unit that uses an eccentric rotor for oscillating a drive pawl and pushing the cam unit with step-by-step increments instead of using reduction gears.

Whatever a driving mechanism is used, the cam unit moves in a predetermined timing speed as the driving motor runs in a specific speed. When a serial control program is made on the cam unit, the rotational cycling angle of the cam wheel (equal or less than 360 angular degree of a revolution) is shared by the whole program timing. If the program is complicated and some control tracks have relatively small activating time periods, then the resolution, precision and endurance of tracks on the cam unit are hard to be achieved due to mechanical restrictions. For example, if a serial program lasts 3 hours (180 minutes), then a half-minute on/off cam shares only 1 angular degree for forming a ramp, peak and valley on the track to activate the contact switch follower. The small peak portion is weak and easy to be deformed. Therefore, it is often desired to include more programs or longer timing intervals on a cam unit while providing higher timing resolution for some small timing intervals.

An ideal solution of the need is to provide a two-speed or multiple-speed timer that during a longer timing section, a reduced timing speed mechanism works; while at the rest, a normal timing speed mechanism functions.

In a dishwasher program timer, for example, it is often desired to set up a dishwasher but delay the running of the program cycle for a number of hours. Some attempts in the past to provide a program timer with a delayed start feature have utilized a second motor to time the delay period. Other attempts have utilized a complex arrangement driven by the timer motor to prevent the main program from becoming effective during the delay period.

U.S. Pat. No. 4,649,239 discloses a program timer having a timing cam member including a delay ratchet wheel having a pin which engages an abutment inside the cam member at one relative position of the delay ratchet to the cam member. The cam member ratchet ring has a gap at the desired delay position so that when the delay ratchet wheel is set to a desired delay, and the drive pawl is at the delay position, the drive pawl extends into the gap to only move the delay ratchet wheel until the pin engages the cam member. The cam member is then advanced along with the delay ratchet wheel until such time as the gap in the cam member ratchet ring has advanced past the drive pawl. From then on, the regular cam member advance takes over. The delay arrangement of the program timer includes additional delay ratchet wheel with at least a dead zone, resilient tabs, a shoulder and a pin. The cam member ratchet ring is also formed with gaps of omitted teeth. The root radii of the ratchet teeth are no greater than the minimum root radius of the teeth of the ratchet ring. When a delayed start is in effect, the drive pawl extends into the gap of the ratchet ring to engage the ratchet teeth of the ratchet wheel. Accordingly, the ratchet wheel is advanced. The drive pawl continues to advance only the ratchet wheel until the ratchet wheel is in such relative angular position with respect to the cam member that the pin contacts the abutment. The arrangement and construction of the delay timer is rather complicated that requires an additional delay ratchet wheel and specific engagement mechanisms.

These prior attempts all have certain drawbacks such as requiring a separate motor or complicated mechanisms.

SUMMARY OF THE INVENTION

It is an object of the present invention to provide a program timer having at least a section with reduced timing speed different from a major timing speed.

It is a further object of the present invention to provide a program timer utilizing a simple mechanism for both the reduced timing speed and the major timing speed.

An electromechanical program timer according to the invention includes a driving motor, a driving shaft, a cam disk with a main driven gear and a driven ratchet, and a pushing pawl. The driving motor rotationally drives the driving shaft through a first gear formed on the driving shaft. A second gear and an eccentric shaft are formed on the driving shaft for driving the cam disk through the main driven gear and via the pushing pawl to the driven ratchet respectively. The main driven gear includes at least a missing gear portion where the second gear is free from driving the main driven gear, and the pushing pawl and the driven ratchet take place. The driving shaft engages and rotates the cam disk through the main driven gear in a major timing speed. While at the missing gear portion, the eccentric shaft oscillates the pushing pawl and drives the cam disk through the driven ratchet in a reduced timing speed. The eccentric shaft oscillates the pushing pawl once per revolution of the driving shaft so as to provide the cam disk with the reduced timing speed.

BRIEF DESCRIPTION OF THE DRAWINGS

The invention will become more fully understood from the detailed description given hereinbelow. However, this description is for purposes of illustration only, and thus is not limitative of the invention, wherein.

DETAILED DESCRIPTION OF THE INVENTION

Figure 1:
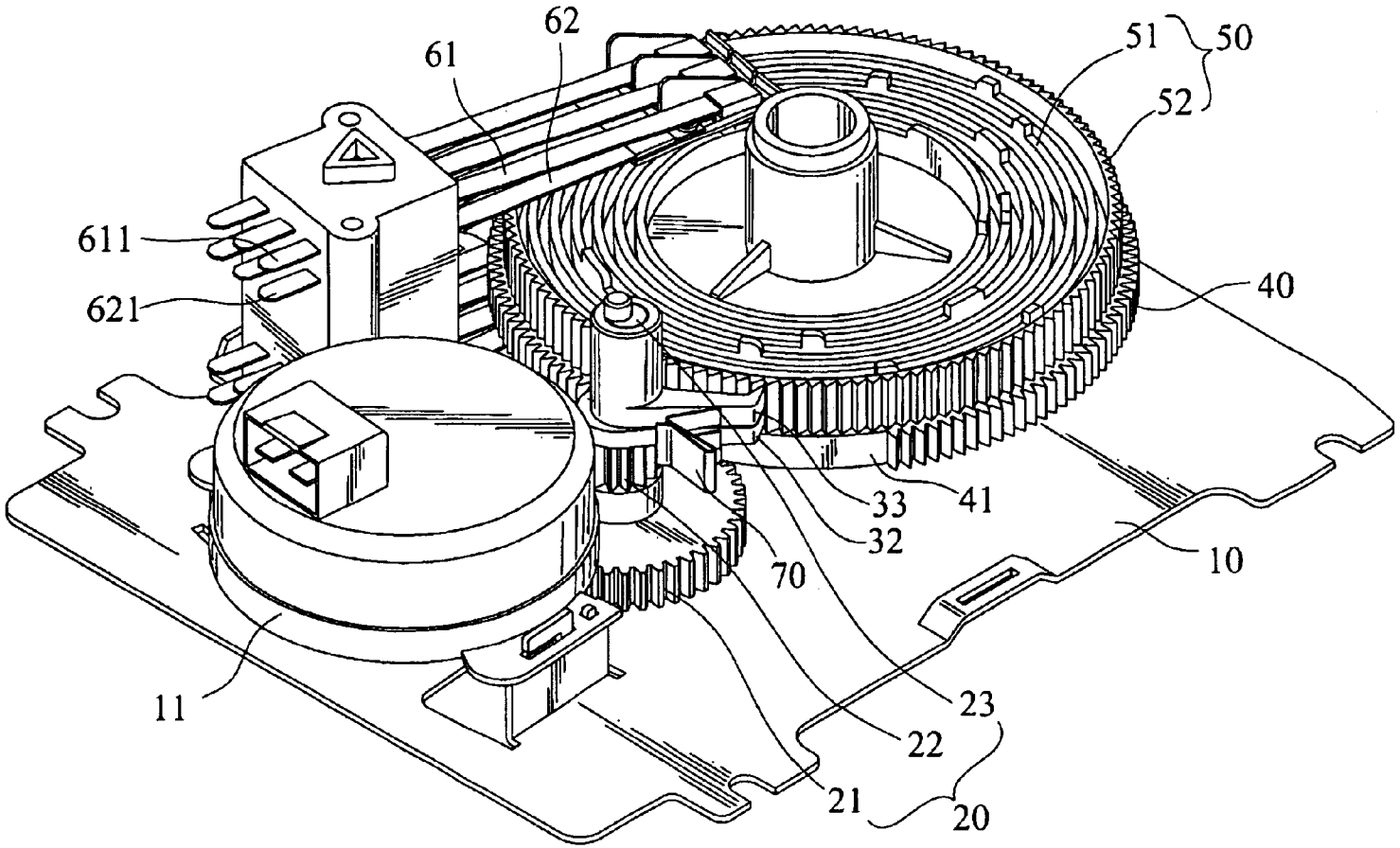
FIG. 1 is a constructional view of a program timer according to the invention.

As shown in FIG. 1, a preferred embodiment of an electromechanical program timer according to the invention includes a driving motor 11, a driving shaft 20, a cam disk 50 with a main driven gear 40 and a driven ratchet 52, and a pushing pawl 33. The driving motor 11, such a reduction motor or a step motor, mounted on a base 10 rotationally drives the driving shaft 20 through a first gear 21 fixedly formed on the driving shaft 20. A second gear 22 and an eccentric shaft 23 are fixedly formed on the driving shaft 20 for driving the cam disk 50 through the main driven gear 40 and via the pushing pawl 33 to the driven ratchet 52 respectively. The pushing pawl 33 has a hole to be pivoted on the eccentric shaft 23 so as to get a back and forth motion to push the driven ratchet 52 step by step in one direction through its ratchet teeth. An anti-reverse pawl 32 for holding the driven ratchet 52 is also pivotally mounted on the driving shaft 20 in a concentric shaft portion that provides no oscillation motion to the anti-reverse pawl 32. A resilient member 70 provides resilient forces to the pushing pawl 33 and the anti-reverse pawl 32 for always contacting the two to the driven ratchet 52. The teeth of the driven ratchet 52 are in one-way direction so that the ratchet 52 can only be driven in one direction (counterclockwise herein) by oscillation of the pushing pawl 33 and prevented from reverse or free movement by the anti-reverse pawl 32. There is an upper cover (not shown in the drawing) for fixing to the base 10 and enclosing the components.

The main driven gear 40 engaged with the second gear 22 includes at least a missing gear portion 41 where the second gear 22 is free from driving the main driven gear 40, and the pushing pawl 32 and the driven ratchet 52 take place. The driving shaft 20 engages and rotates the cam disk 50 through the main driven gear 40 in a major timing speed. While at the missing gear portion 41, the eccentric shaft 23 oscillates the pushing pawl 32 and drives the cam disk 50 through the driven ratchet 52 in a reduced timing speed. The eccentric shaft 23 oscillates the pushing pawl 32 once per revolution of the driving shaft 20 so as to provide the cam disk 50 with the reduced timing speed.

On one side or both sides of the cam disk 50, there are a plurality of cam tracks 51 each having at least a cam portion composed of a ramp, a peak and a valley for activating a cam follower blade 62 contacting with a switch contact blade 61 for a predetermined time period as a switch function. A specific circuit or electrical component, such as pump, solenoid, heater, etc., connected to the blade terminals 611, 621, are then controlled accordingly in predetermined time sequence. Another possible style of cam unit is a cam drum having a plurality of cam tracks formed on the circumference of the cam drum for actuating some contact switches radially, which functions the same as the above cam disk and contact switches.

Figure 2A:
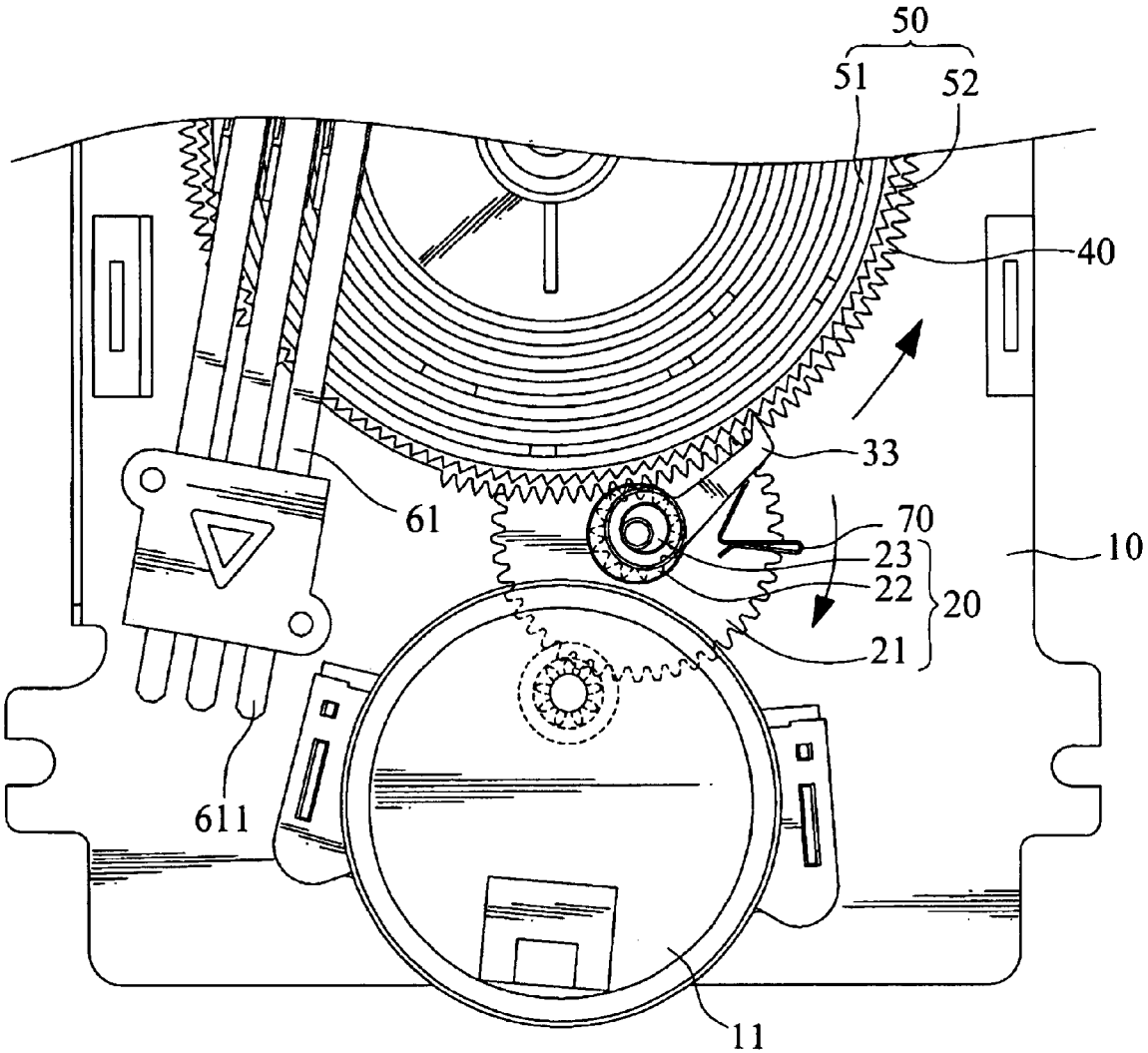
FIGS. 2A to 2G are some sequential functional views of an embodiment of the invention.

Normally, as shown in FIG. 2A, the second gear 22 engages the main driven gear 40 to transfer rotational power of the driving motor 11 to the cam disk 50 and activates the switch functions of the switch contact blades 61 and the cam follower blades 62 through the cam tracks 51. Under the transmission, the cam disk 50 rotates in a major (faster) timing speed. Though the anti-reverse pawl 32 and the pushing pawl 33 are touching the driven ratchet 52 by the resilient force of the resilient member 70, they slip as the driven ratchet 52 rotates along with the main driven gear 40 in the driven (counterclockwise) direction in the major timing speed. The pushing pawl 33 oscillates once each revolution of the driving shaft 20 and provides a pushing force to move the driven ratchet 52 in a step-by-step motion through a pawl end engaged with the ratchet teeth. The driven direction of the driven ratchet 52 by the pushing pawl 33 is the same (counterclockwise) as that of the main driven gear 40 by the second gear 22, but in a relatively slow speed, therefore, it gives no influence to the cam disk 50 rotation when the disk 50 is driven through the main driven gear 40.

Figure 2B:
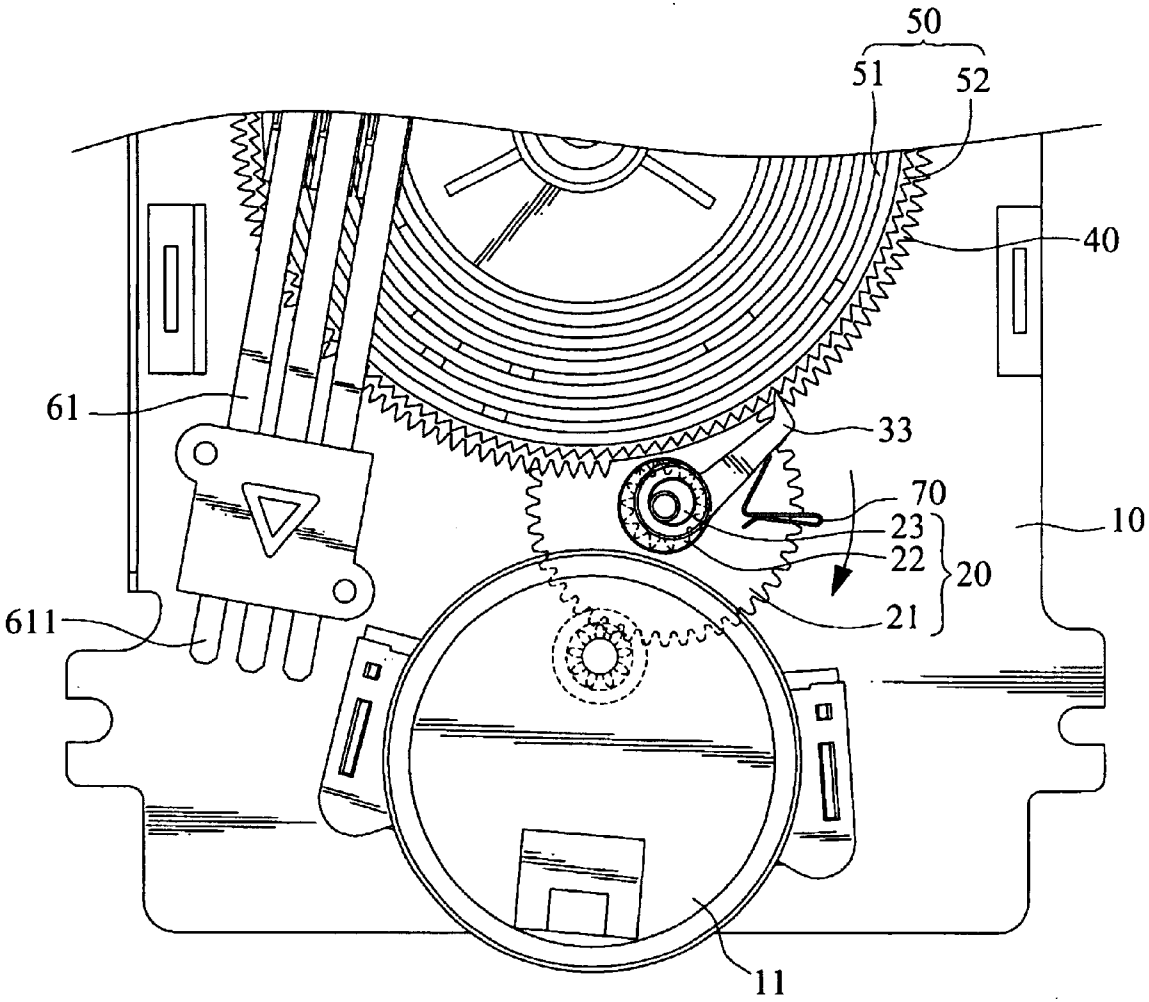
Figure 2C:
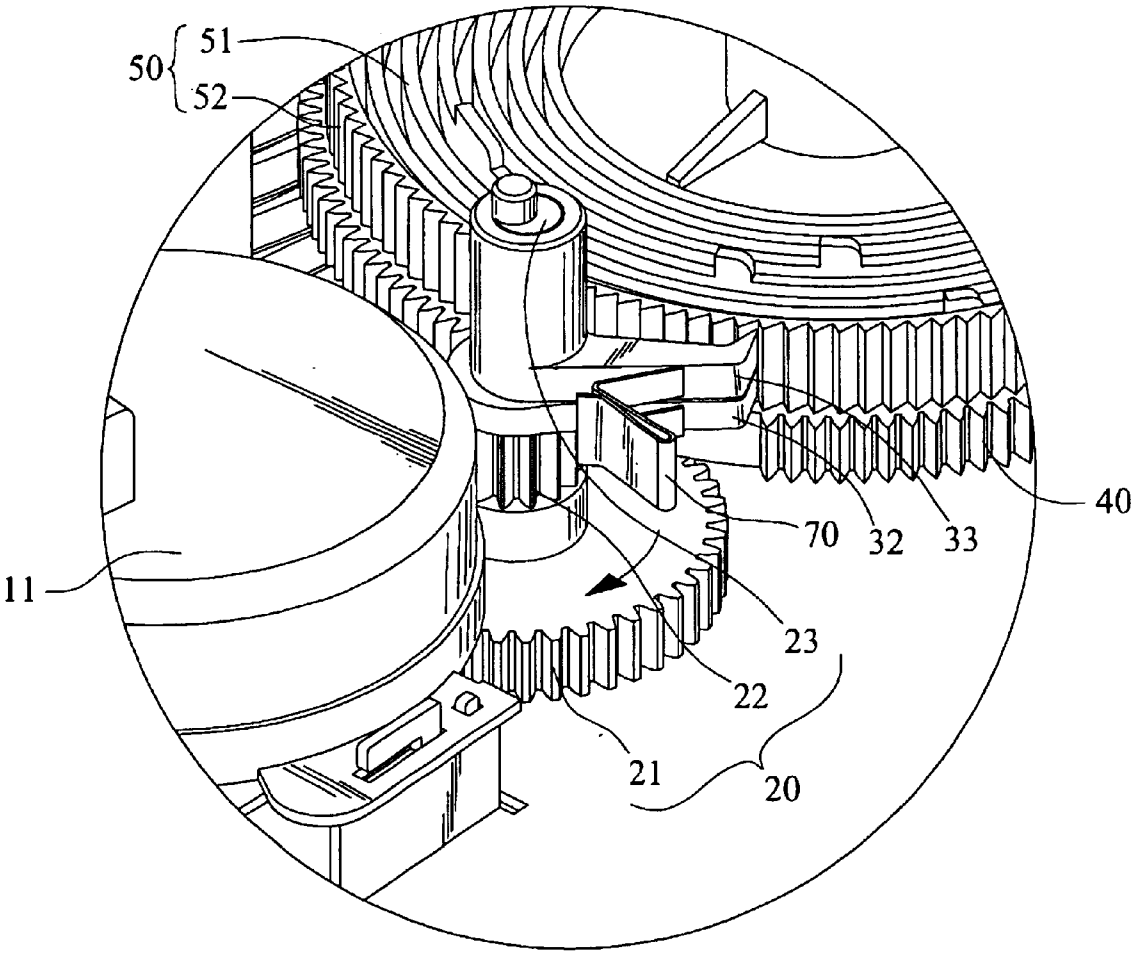
Figure 2D:
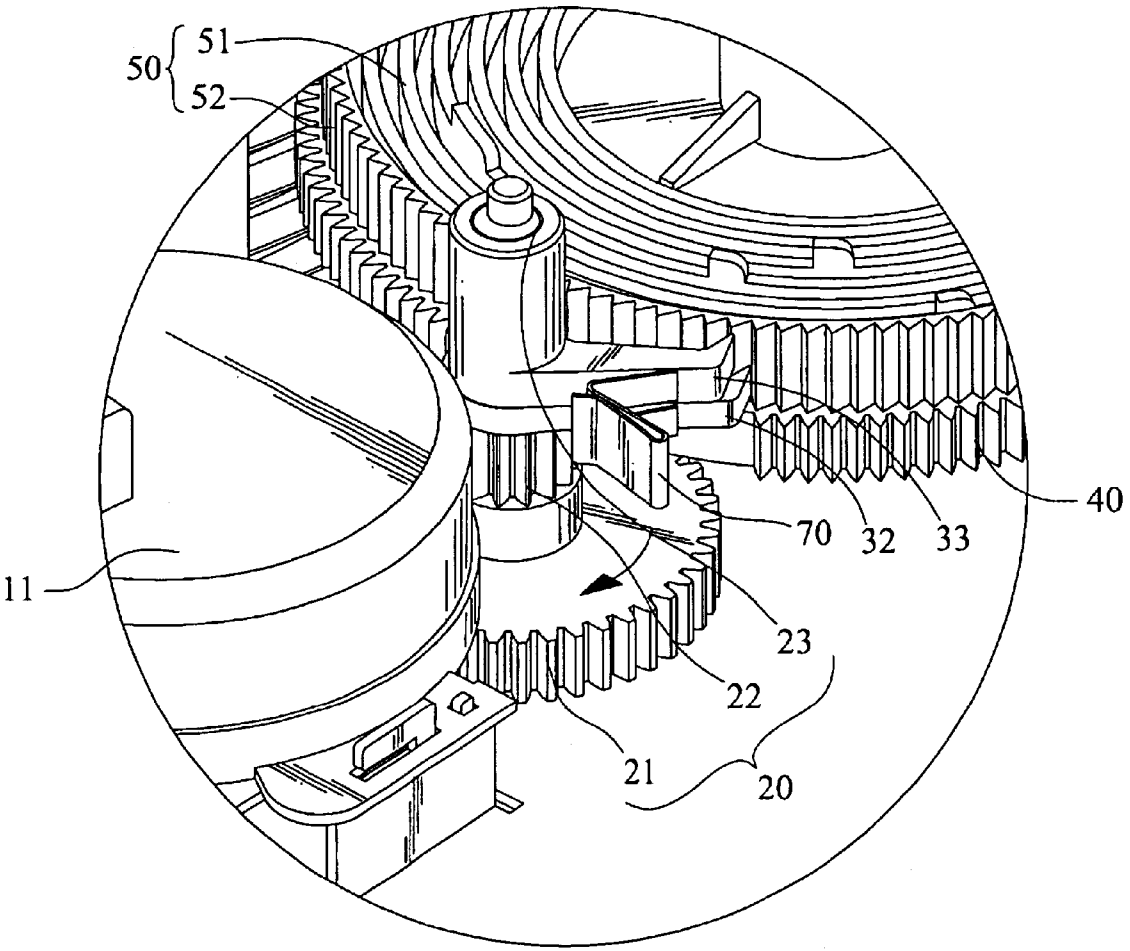
Figure 2E:
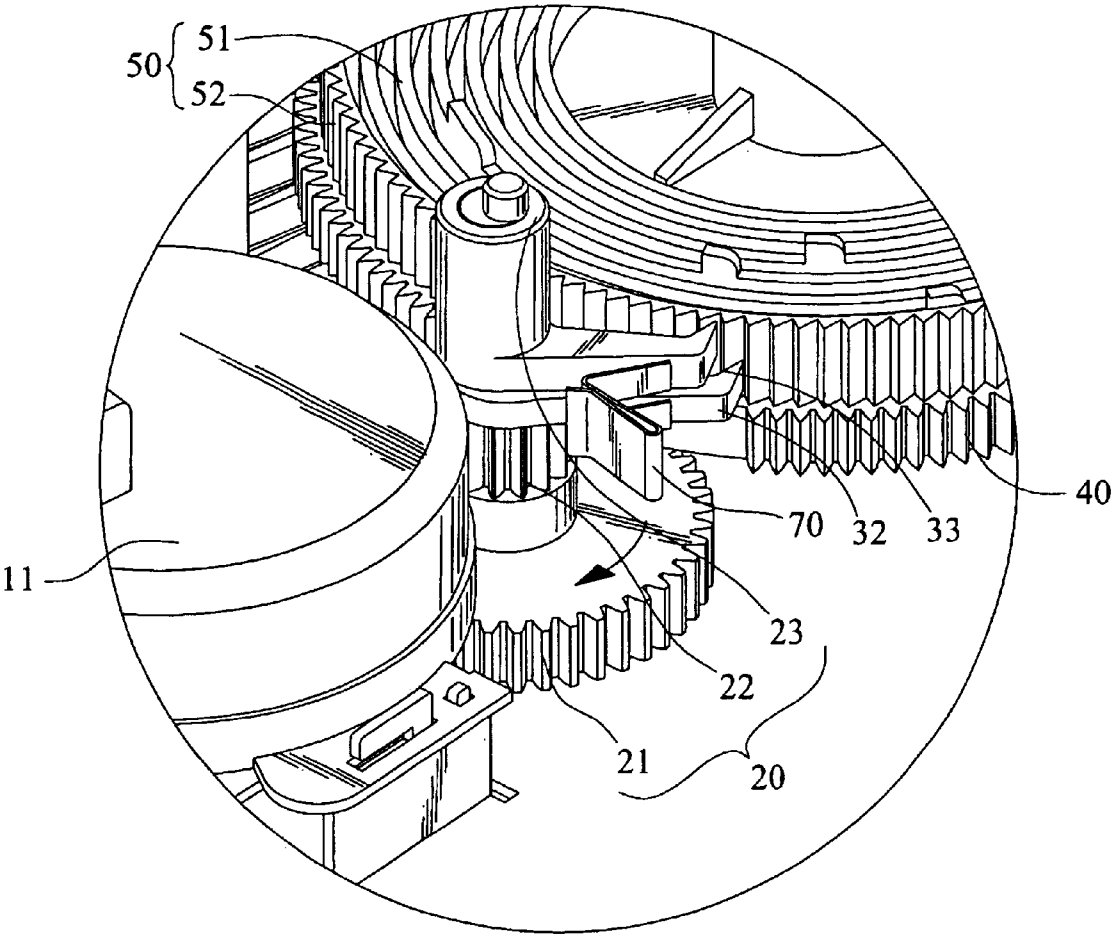
Figure 2F:
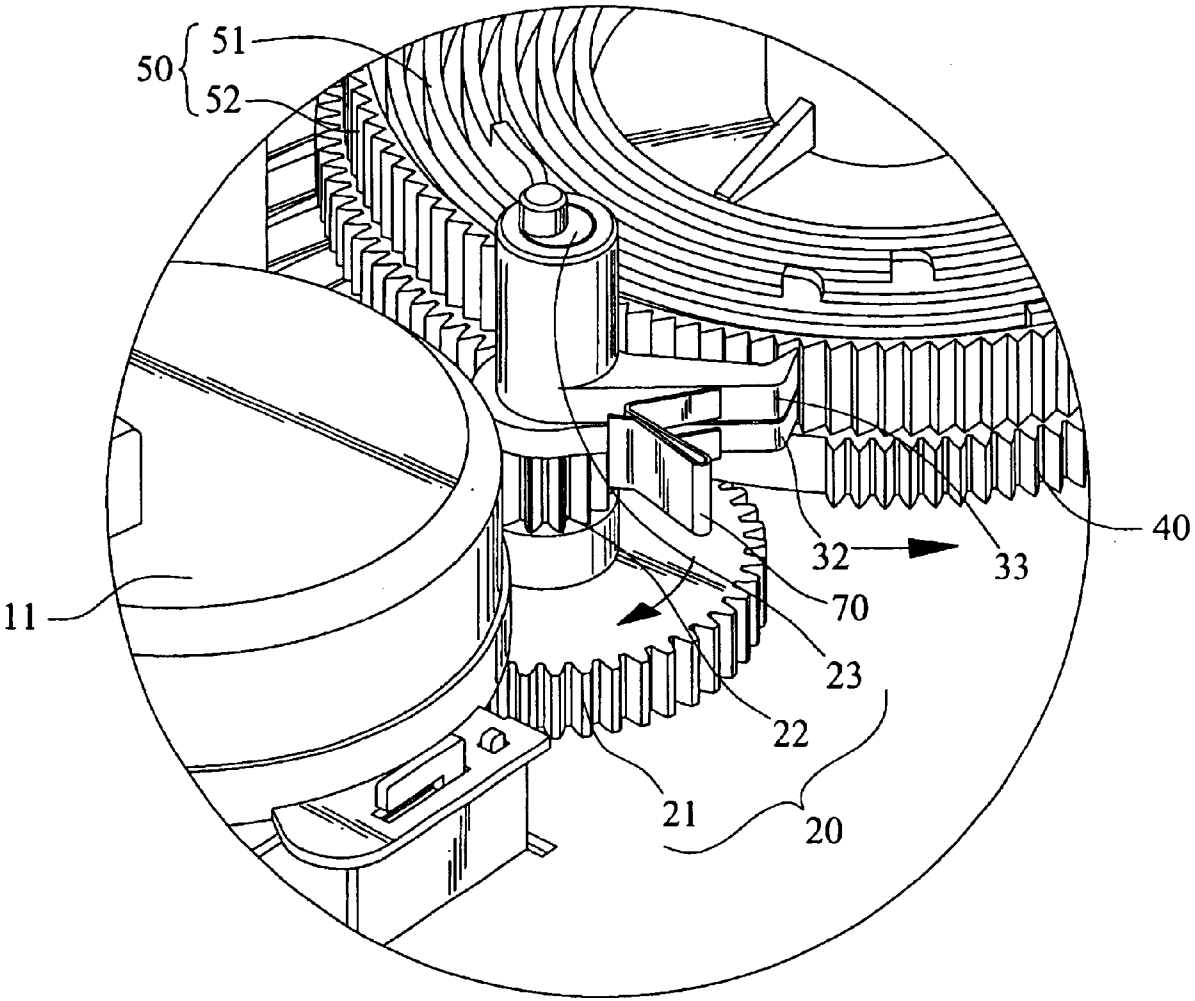
Figure 2G:
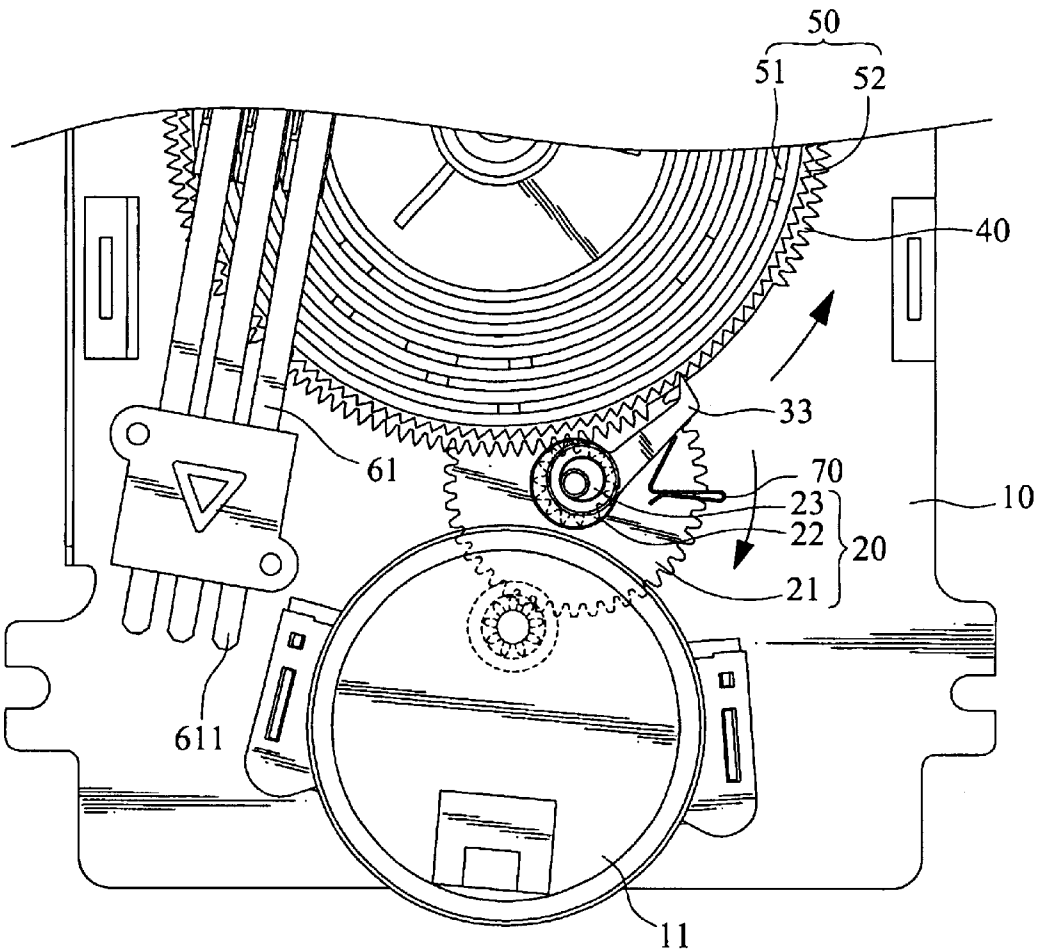

Then, in FIGS. 2B and 2C, the second gear 22 faces the missing gear portion 41 of the main driven gear 40. No gear engagement is provided. Therefore, the rotation of the driving shaft 20 provides only the oscillation of the pushing pawl 33. The pushing pawl 33 thus pushes the cam disk 50 forward with one tooth each revolution of the driving shaft 20 (FIGS. 2D to 2F). The resilient member 70 provides resilient force to push the pushing pawl 33 and the anti-reverse pawl 32 toward the driven ratchet 52 so that the oscillation of the pushing pawl 33 activates the driven ratchet forward, and the anti-reverse pawl 32 always contacts the driven ratchet 52 to prevent it from free or reversed rotation.

It is apparent that the tooth pitch of the driven ratchet 52 can be similar to, as shown in the drawings, or smaller or larger than the pitch of the main driven gear 40. A smaller pitch drives the driven ratchet 52 even slower, while a larger pitch drives the driven ratchet 52 faster. Also, the missing gear portion 41 in the main driven gear 40 can be arranged at any position where a lower timing speed is required. In order words, one or more sections of lower timing speed can be arranged in a program cycle.

The advantage of the program timer of the invention is that the cam unit (cam disk or cam drum) is driven continuously and evenly (instead of step by step) through gears in the major timing speed sections that give precise timing control. The reduced timing speed sections actuated through the pushing pawl and the driven ratchet are easy to be arranged with required speed and positions. The composition is simple and reliable that the driven ratchet, the main driven gear and the cam unit can be just of a unitary member.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An electromechanical program timer with delay sections capable of actuating at least a contact switch for controlling electrical actuators connected thereto, comprising at least:

driving means for providing a rotational power;

a driving shaft, driven by said driving means, having an eccentric shaft and a driving gear;

a main driven gear, having at least a missing gear portion, rotationally mounted adjacent to said driving shaft for being engaged with said driving gear and driven thereby in a major timing speed;

a cam unit, fixed to said main driven gear, having at least a circular cam track for actuating said contact switch, and a driven ratchet formed with a plurality of ratchet teeth; and a pushing pawl, having one end pivotally mounted on said eccentric shaft, and a pawl end engaged with ratchet teeth of said driven ratchet;

when said main driven gear being driven to said missing gear portion, said pushing pawl activated by said eccentric shaft pushes said driven ratchet moving in a relatively lower timing speed.

2. An electromechanical program timer with delay sections according to claim 1 wherein said driving means is a motor.

3. An electromechanical program timer with delay sections according to claim 1 wherein said driving shaft further comprises a driven gear engaged with said driving means.

4. An electromechanical program timer with delay sections according to claim 1 wherein said pushing pawl is pressed by a resilient member for maintaining engagement with said driven ratchet.

5. An electromechanical program timer with delay sections according to claim 1 further comprises an anti-reverse pawl pivotally mounted on said driving shaft and engaging with said driven ratchet for preventing reverse of said main driven gear.

6. An electromechanical program timer with delay sections according to claim 5 wherein said anti-reverse pawl is pressed by a resilient member for maintaining engagement with said driven ratchet.

7. An electromechanical program timer with delay sections according to claim 1 wherein each of said circular cam track comprises at least a ramp, peak and valley for activating and turning on and off of an electrical actuator connected thereto.

8. An electromechanical program timer with delay sections according to claim 1 wherein said cam unit is a disk having a plurality of circular cam tracks formed on at least one side of said disk.

9. An electromechanical program timer with delay sections according to claim 1 wherein said ratchet teeth are formed with suitable pitch for accommodating said lower timing speed.

* * * * *